US009798338B2

(12) United States Patent
Van de Beek

(10) Patent No.: US 9,798,338 B2
(45) Date of Patent: Oct. 24, 2017

(54) DIGITALLY CONTROLLABLE POWER SOURCE

(71) Applicant: NXP B.V., Eindhoven (NL)

(72) Inventor: Remco Van de Beek, Eindhoven (NL)

(73) Assignee: NXP B.V., Eindhoven (NL)

( * ) Notice: Subject to any disclaimer, the term of this patent is extended or adjusted under 35 U.S.C. 154(b) by 47 days.

(21) Appl. No.: 14/818,256

(22) Filed: Aug. 4, 2015

(65) Prior Publication Data

US 2016/0036325 A1 Feb. 4, 2016

(30) Foreign Application Priority Data

Aug. 4, 2014 (EP) ..... 14179647

(51) Int. Cl.
*G05F 3/16* (2006.01)
*G05F 1/46* (2006.01)

(52) U.S. Cl.
CPC ..... *G05F 1/462* (2013.01)

(58) Field of Classification Search
CPC . G05F 3/26; G05F 3/262; G05F 3/265; G05F 3/267; G05F 1/10; G05F 1/46; G05F 3/30
USPC ..... 323/315; 327/538–541
See application file for complete search history.

(56) References Cited

U.S. PATENT DOCUMENTS 3,727,135 A 4/1973 Holzer
4,229,703 A 10/1980 Bustin
4,356,450 A 10/1982 Masuda
5,940,447 A 8/1999 Connell et al.
6,054,887 A 4/2000 Horie et al.
6,426,663 B1 7/2002 Manlove et al.
6,466,007 B1 10/2002 Prazeres da Costa et al.
6,657,488 B1 12/2003 King et al.
6,680,985 B1 1/2004 Strodtbeck et al.
7,026,866 B2 4/2006 Llewellyn
7,765,080 B2 7/2010 Ludwig et al.
8,358,708 B2 1/2013 Takemoto et al.
9,136,760 B2 * 9/2015 Wismar ..... H02M 3/157
9,214,865 B2 * 12/2015 Levesque ..... H02M 3/1584
2004/0135673 A1 7/2004 Oberhuber et al.
2004/0179510 A1 9/2004 Kuffner et al.
2006/0008685 A1 1/2006 Mizude et al.
2006/0154599 A1 7/2006 Altaf et al.
2007/0075143 A1 4/2007 Higashi
2009/0032935 A1 2/2009 Bhowmik et al.
(Continued)

FOREIGN PATENT DOCUMENTS

WO 2006008685 A1 1/2006

OTHER PUBLICATIONS

Partial European Search Report for Patent Appln. No. 14179647.4 (May 15, 2015).

(Continued)

*Primary Examiner* — Adolf Berhane
*Assistant Examiner* — Afework Demisse

(57) ABSTRACT

Embodiments of power source circuits and methods for operating a power source circuit are described. In one embodiment, a method for operating a power source circuit involves receiving at the power source circuit at least one digital signal from a feedback loop and increasing or decreasing an output power signal of the power source circuit in response to the at least one digital signal. Other embodiments are also described.

18 Claims, 10 Drawing Sheets

(56) References Cited

U.S. PATENT DOCUMENTS

| | | | |
|---|---|---|---|
| 2009/0033462 | A1 | 2/2009 | Kitayoshi et al. |
| 2009/0046809 | A1 | 2/2009 | Meltzer |
| 2009/0154599 | A1 | 6/2009 | Siti et al. |
| 2009/0189688 | A1 | 7/2009 | Nehrig et al. |
| 2010/0158157 | A1 | 6/2010 | Iwata et al. |
| 2011/0121880 | A1 | 5/2011 | Lee et al. |
| 2012/0057656 | A1 | 3/2012 | Bae et al. |
| 2012/0083205 | A1 | 4/2012 | Marcu et al. |
| 2012/0183100 | A1 | 7/2012 | Luzzi et al. |
| 2014/0086347 | A1 | 3/2014 | Kang |
| 2014/0192931 | A1 | 7/2014 | VandeBeek et al. |
| 2015/0172080 | A1 | 6/2015 | Van de Beek et al. |

OTHER PUBLICATIONS

ISO/IEC 14443-2:2001 Identification cards—Contactless integrated circuit(s) cards—Proximity cards—Part 2: Radio frequency power and signal interface, 2001.

"RFID Handbook: Fundamentals and Applications in Contactless Smart Cards, Radio Frequency Identification and Near-Field Communication—2nd Ed."; Klaus Finkenzeller, ISBN: 0-470-84402-7, p. 278, 2003.

M. van Elzakker et al.; "A 1.9uW 4.4fJ/Conversion-step 10b 1MS/s Charge-Redistribution ADC"; in ISSCC Dig. Tech Papers, Feb. 2008.

European Search Report , 14179647.4, Oct. 5, 2015.

European Search Report , 13199914.6, May 21, 2014.

European Search Report , 14192871.3, Apr. 8, 2015.

* cited by examiner

DIGITALLY CONTROLLABLE POWER SOURCE

CROSS-REFERENCE TO RELATED APPLICATIONS

This application claims the priority under 35 U.S.C.§119 of European patent application no. 14179647.4, filed on Aug. 4, 2014, the contents of which are incorporated by reference herein.

BACKGROUND

Power sources with accurately controlled output power levels are important for the proper function of electrical circuits. For example, accurately controllable current sources can be used in various positions within the signal path of an analog signal processing chain in order to cancel an unwanted direct current (DC) element. Without accurately controllable current sources, a digital-to-analog converter (DAC) is typically inserted in an analog signal processing chain to counter the effect of DC offset in amplifier circuits that can cause distortion or even clipping further along in the analog signal processing chain. However, realizing the desired combination of accuracy and range in a DAC typically requires increased design complexity on the one hand and significantly increases silicon area on the other. In addition, the control algorithm of such a DAC normally requires strict monotonicity of the DAC input-output relation.

SUMMARY

Embodiments of power source circuits and methods for operating a power source circuit are described. In one embodiment, a method for operating a power source circuit involves receiving at the power source circuit at least one digital signal from a feedback loop and increasing or decreasing an output power signal of the power source circuit in response to the at least one digital signal. Based on a digital signal from the feedback loop, the output power signal of the power source circuit can be gradually changed and accurately controlled. Other embodiments are also described.

In an embodiment, a power source circuit includes a digital controller configured to receive at least one digital signal from a feedback loop and a power signal generation circuit configured to increase or decrease an output power signal in response to the at least one digital signal.

In an embodiment, a current source circuit includes a digital controller configured to receive a digital activation signal and a digital control signal from a feedback loop and a current generation circuit configured to increase or decrease an output current during a rising edge of the digital activation signal based on the Boolean value of the digital control signal. The current generation circuit includes a first type of switching devices, a second type of switching devices, and a capacitor connected to a node between the first type of switching devices and the second type of switching devices.

Other aspects and advantages of embodiments of the present invention will become apparent from the following detailed description, taken in conjunction with the accompanying drawings, depicted by way of example of the principles of the invention.

BRIEF DESCRIPTION OF DRAWINGS

Throughout the description, similar reference numbers may be used to identify similar elements.

DETAILED DESCRIPTION

It will be readily understood that the components of the embodiments as generally described herein and illustrated in the appended figures could be arranged and designed in a wide variety of different configurations. Thus, the following detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment.

Rather, language referring to the features and advantages is understood to mean that a specific feature, advantage, or characteristic described in connection with an embodiment is included in at least one embodiment. Thus, discussions of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment," "an embodiment," or similar language means that a particular feature, structure, or characteristic described in connection with the indicated embodiment is included in at least one embodiment. Thus, the phrases "in one embodiment," "in an embodiment," and similar language throughout this specification may, but do not necessarily, all refer to the same embodiment.

Figure 1:
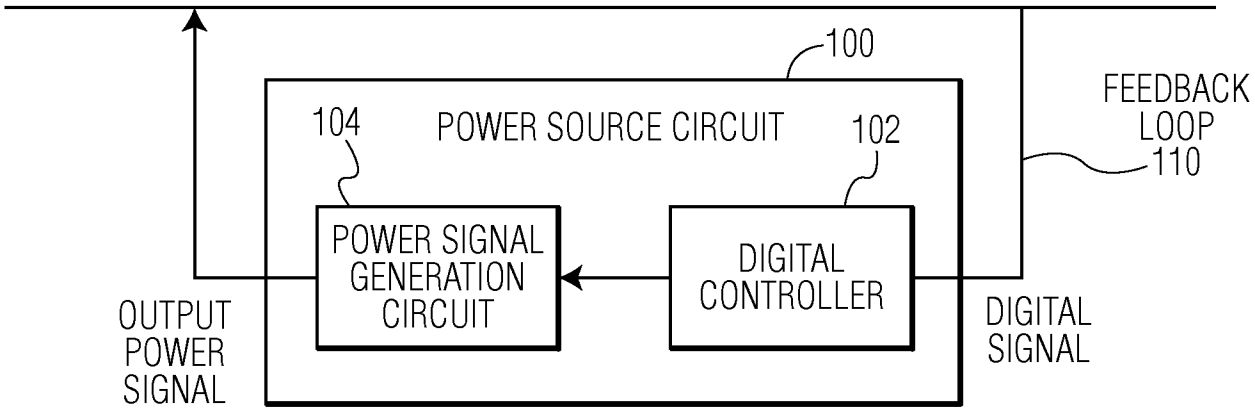
FIG. 1 is a schematic block diagram of a power source circuit that is used in a feedback loop in accordance with an embodiment of the invention.

FIG. 1 is a schematic block diagram of a power source circuit 100 that is used in a feedback loop 110 in accordance with an embodiment of the invention. In the embodiment depicted in FIG. 1, the power source circuit includes a digital controller 102 and a power signal generation circuit 104. The power source circuit can be used to generate a desired current and/or a desired voltage. The power source circuit can be used to compensate DC offsets in analog circuitry such as amplifiers and analog-to-digital converters. The power source circuit can achieve high accuracy with a wide range, without the need for a highly accurate digital-to-analog converter. In addition, the power source circuit is monotonous rather than requiring thermometer coding. Although the power source circuit is shown in FIG. 1 as including certain components, in some embodiments, the power source circuit includes less or more components to implement less or more functionalities.

In the embodiment depicted in FIG. 1, the power source circuit 100 is used in the feedback loop 110, which may be a direct current (DC) offset cancellation loop. Based on one or more feedback digital signals from the feedback loop, the power source circuit can control the exact output voltage/current. For example, the power source circuit can control the pace of change of the output voltage/current based on feedback signals from the feedback loop.

The digital controller 102 of the power source circuit is configured to generate at least one control signal to control the power signal generation circuit 102. In the embodiment depicted in FIG. 1, the digital controller is configured to receive at least one digital signal from the feedback loop 110.

The power signal generation circuit 104 of the power source circuit 100 is configured to generate a desired output current and/or a desired output voltage. In the embodiment depicted in FIG. 1, the power signal generation circuit is configured to increase or decrease an output power signal, which may be an output current signal or an output voltage signal, in response to at least one digital signal from the feedback loop 110. Based on the feedback digital signal from the feedback loop, the output power signal of the power source circuit can be gradually changed and accurately controlled.

In some embodiments, the digital controller 102 receives a digital activation signal and a digital control signal. In these embodiments, the power signal generation circuit 104 increases or decreases its output power signal during a rising edge of the digital activation signal based on the Boolean value of the digital control signal. For example, the power signal generation circuit increases the output power signal during the rising edge of the digital activation signal if the Boolean value of the digital control signal is 1 and decreases the output power signal during a rising edge of the digital activation signal if the Boolean value of the digital control signal is 0.

In some embodiments, the power signal generation circuit 104 includes a first type of switching devices, a second type of switching devices, and a capacitor connected to a node between the first type of switching devices and the second type of switching devices. In these embodiments, the digital controller 102 causes an increase or a decrease in a voltage of the capacitor in response to the at least one digital signal. The first type of switching devices may include PMOS transistors while the second type of switching devices may include of NMOS transistors. In some embodiments, the digital controller activates and subsequently deactivates a first switching device of the power signal generation circuit and activates a second switching device of the power signal generation circuit, which is of the same type as the first switching device.

Figure 2:
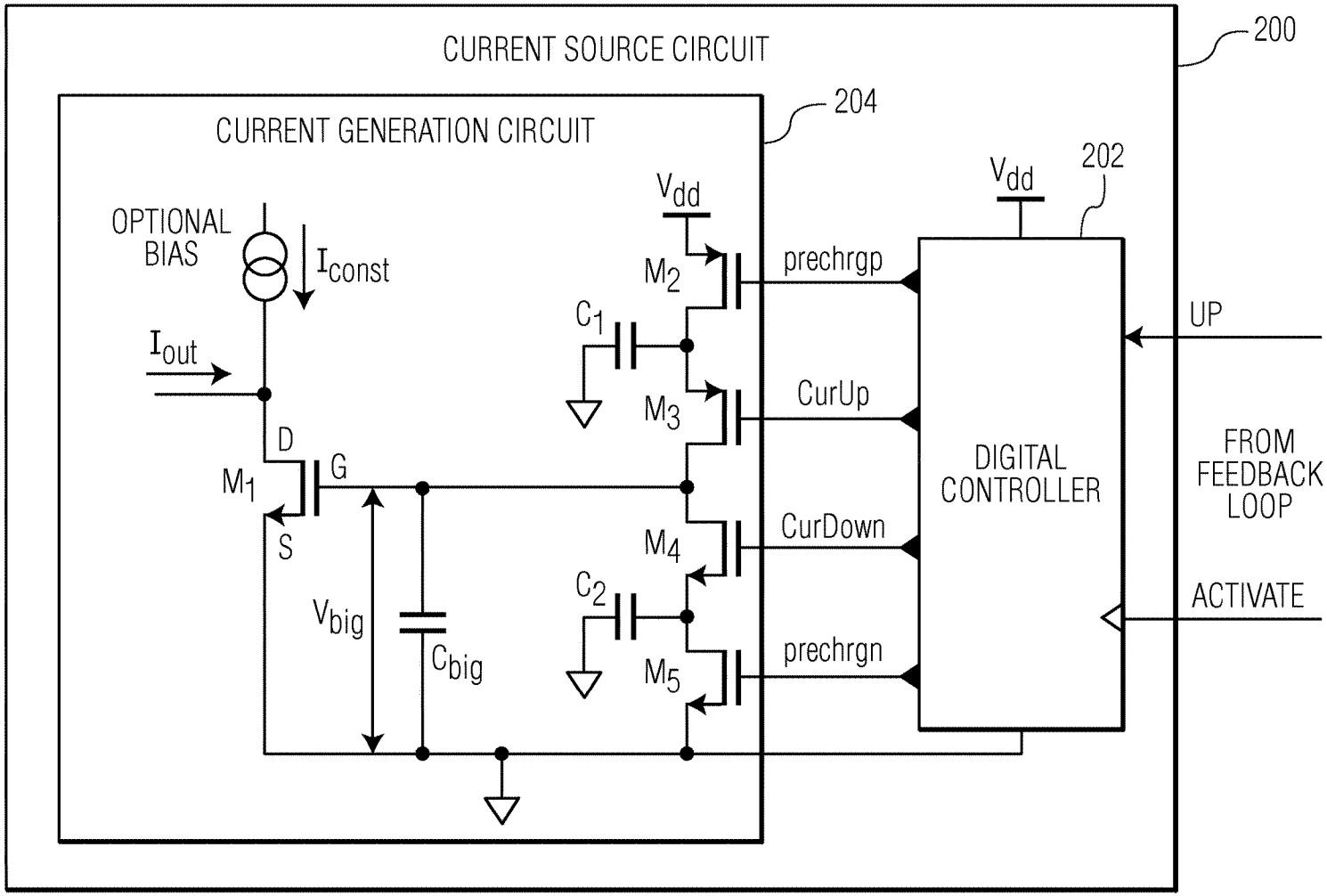
FIG. 2 depicts an embodiment of the power source circuit depicted in FIG. 1 that is used to generate an output current.

In some embodiments, the power source circuit 100 depicted in FIG. 1 is a current source circuit that is used to generate an output current. FIG. 2 depicts an embodiment of the power source circuit depicted in FIG. 1 that is used to generate an output current, "$I_{out}$." In the embodiment depicted in FIG. 2, a current source circuit 200 includes a digital controller 202 and a current generation circuit 204. The current source circuit depicted in FIG. 2 is one possible embodiment of the power source circuit depicted in FIG. 1. However, the power source circuit depicted in FIG. 1 is not limited to the embodiment shown in FIG. 2. In some embodiments, an optional bias current source is used to allow the sign of the output current, "$I_{out}$," to be both positive as well as negative (i.e., the output current, "$I_{out}$," to flow in either direction).

In an example of the operation of the current source circuit 200, the current source circuit increases the output current, "$I_{out}$," by a small amount when a digital control signal, "up," is enabled during a rising edge of a digital activation signal, "activate," and decreases the output current, "$I_{out}$," when the digital control signal, "up," is not enabled during a rising edge of the digital activation signal, "activate." Consequently, the current source circuit can gradually change and accurately control the output current, "$I_{out}$."

The digital controller 202 is configured to generate at least one signal to control the current generation circuit 204 in response to one or more digital signals from the feedback loop 110 (shown in FIG. 1). In the embodiment depicted in FIG. 2, the digital controller generates control signals, "prechrgp," "CurUp," "CurDown," "prechrgn," in response to digital signals, "up," "activate," from the feedback loop. The digital controller is connected to a positive voltage, "$V_{dd}$."

The current generation circuit 204 is configured to generate a desired current based on the control signals, "prechrgp," "CurUp," "CurDown," "prechrgn," from the digital controller 202. In the embodiment depicted in FIG. 2, the current generation circuit includes four switching devices that are implemented by transistors, "M2," "M3," "M4," "M5," a capacitor, "$C_{big}$," and a voltage-to-current conversion device, which is implemented by a transistor, "M1." PMOS transistors, M2 and M3 are used to increase the output current, "$I_{out}$," while NMOS transistors, M4 and M5 are used to reduce the output current, "$I_{out}$." Although the switching devices are implemented by transistors in the embodiment depicted in FIG. 2, in other embodiments, switching devices of the current generation circuit are implemented by other types of circuits.

NMOS transistor, M1, delivers the output current, "$I_{out}$," at its drain terminal, "D." The NMOS transistor, M1, is connected in parallel with the capacitor, $C_{big}$, at its gate and source terminals, "G," and, "S," and the value of the output current, "$I_{out}$," is controlled by the gate-source voltage of the transistor, M1, which is identical to the voltage, "$V_{big}$," applied on the capacitor, $C_{big}$. Consequently, by controlling the voltage, "$V_{big}$," applied on the capacitor, $C_{big}$, the value of the delivered current, "$I_{out}$," can be controlled. The transistors, M2, M3, M4, M5 are connected in series between a positive voltage, "$V_{dd}$," and a fixed voltage, such as the ground. In order to change the voltage, "$V_{big}$," the transistors, M2, M3, M4, M5, can either take away a small amount of electric charge from the capacitor, $C_{big}$, or add a small amount of electric charge to the capacitor, $C_{big}$, thereby gradually changing the output current, "$I_{out}$," delivered by the transistor, M1.

Figure 3:
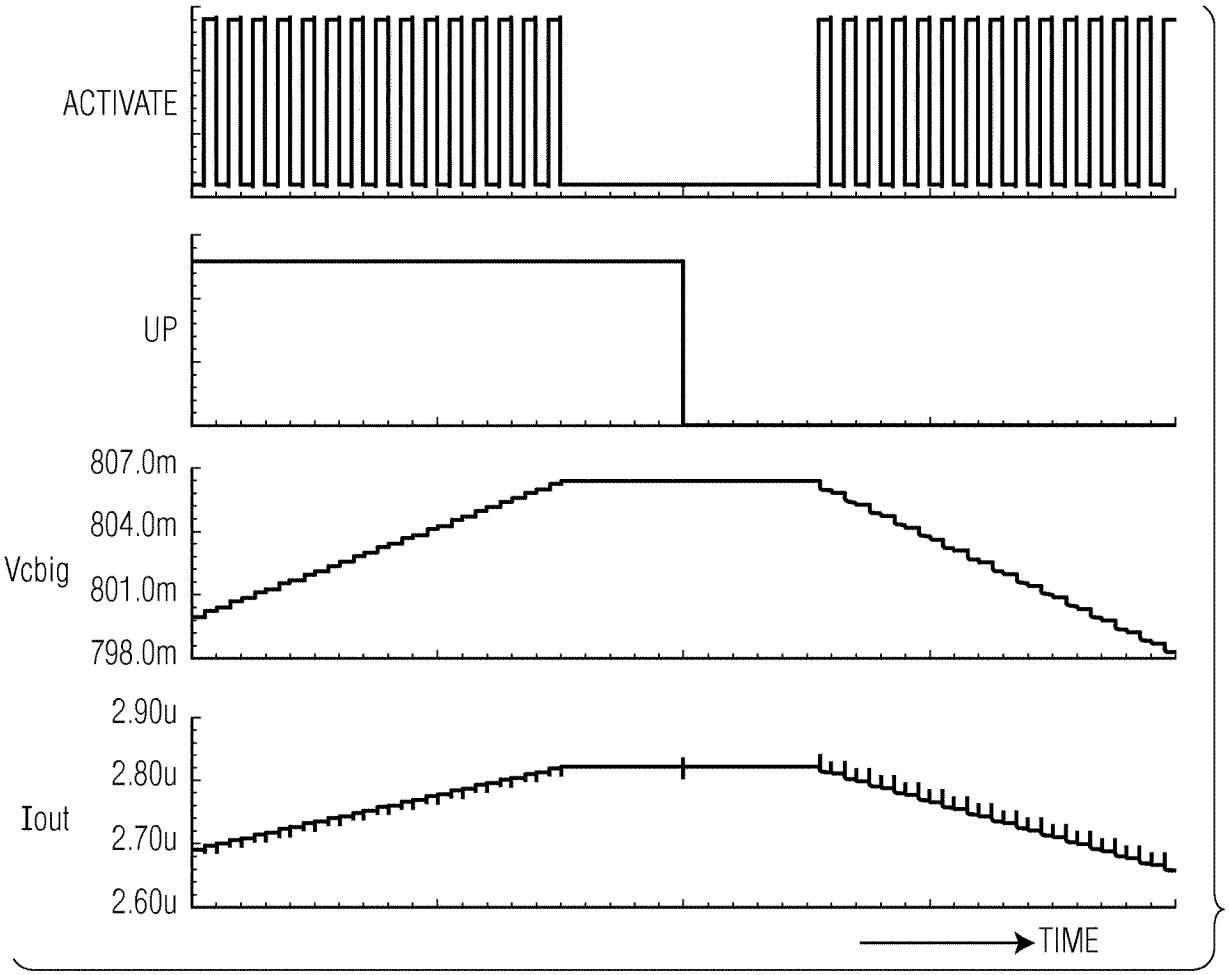
FIG. 3 shows some examples of input signals and output signals of the current source circuit depicted in FIG. 2.

FIG. 3 shows some examples of signals of the current source circuit 200 depicted in FIG. 2. Specifically, FIG. 3 shows the digital input signals, "activate" and "up," which are provided to the digital controller 220 and the voltage signal, "$V_{big}$," and the output current signal, "$I_{out}$." As shown in FIG. 3, the voltage signal, "$V_{big}$," and the current signal, "$I_{out}$," gradually increase 15 times, when the digital control signal, "up," is set to 1 during 15 rising edges of the digital activation signal, "activate." The voltage signal, "$V_{big}$," and the current signal, "$I_{out}$," remain unchanged, when the digital activation signal, "activate," is set to 0. The output voltage, "$V_{big}$," and the output current signal, "$I_{out}$," gradually decrease 15 times, when the digital control signal, "up," is set to 0 during 15 rising edges of the input signal, activate.

In an example of the operation of the current source circuit 200, the digital controller 202 sets the control signal, "prechrgp," to 0 V when the output current, "$I_{out}$," needs to be increased. Setting the control signal, "prechrgp," to 0 V activates the transistor, M2, which charges a capacitor, "C1," to a voltage of Vdd. The capacitor, C1, can be "parasitic" capacitance of the transistors, M2, M3, or implemented as a dedicated capacitor. To transfer some of the electric charge on the capacitor, C1, to the capacitor, $C_{big}$, the digital controller changes the control signal, "prechargp," to the voltage, Vdd, which deactivates the transistor, M2. Subsequently, the digital controller sets the control signal, "CurUp," to 0 V, which activates the transistor, M3, in order to redistribute the electric charges on the capacitors, $C_{big}$, and, C1. The electric charge across the capacitors, C1, and $C_{big}$, is redistributed in a way that the voltage, "$V_{big}$," across the capacitor, $C_{big}$, and the output current, "$I_{out}$," slightly increase. The current change step size (i.e., current change pace) can be controlled by setting the ratio between the capacitance of the capacitor, $C_{big}$, and the capacitance of the capacitor, C1. For example, increasing the ratio between the capacitance of the capacitor, "$C_{big}$," and the capacitance of the capacitor, C1, reduces the current change step size.

In an example of the operation of the current source circuit 200, the digital controller sets the control signal, "prechrgn," to 0 V when the output current, "$I_{out}$," needs to be decreased. Setting the control signal, "prechrgn," to 0 V activates the transistor. M5, which discharges a capacitor, "C2." The capacitor, C2, can be "parasitic" capacitance of the transistors, M4, and M5, or implemented as a dedicated capacitor. To transfer some of the electric charge on the capacitor, $C_{big}$, to the capacitor, C2, the digital controller changes the control signal, "prechrgn," to 0V, which deactivates the transistor, M5. Subsequently, the digital controller sets the control signal, "CurDown," to 0V, which activates the transistor, M4, in order to redistribute the electric charges on the capacitors, $C_{big}$, and C2. The electric charge across the capacitors, $C_{big}$, and, C2, are redistributed in a way that the voltage, "$V_{big}$," across the capacitor, $C_{big}$, and the output current, "$I_{out}$," slightly decrease. The current change step size (i.e., current change pace) can be controlled by setting the ratio between the capacitances of the capacitor, $C_{big}$, and the capacitance of the capacitor, C2. For example, increasing the ratio between the capacitances of the capacitor, $C_{big}$, and the capacitance of the capacitor, C2, reduces the current change step size.

Figure 4:
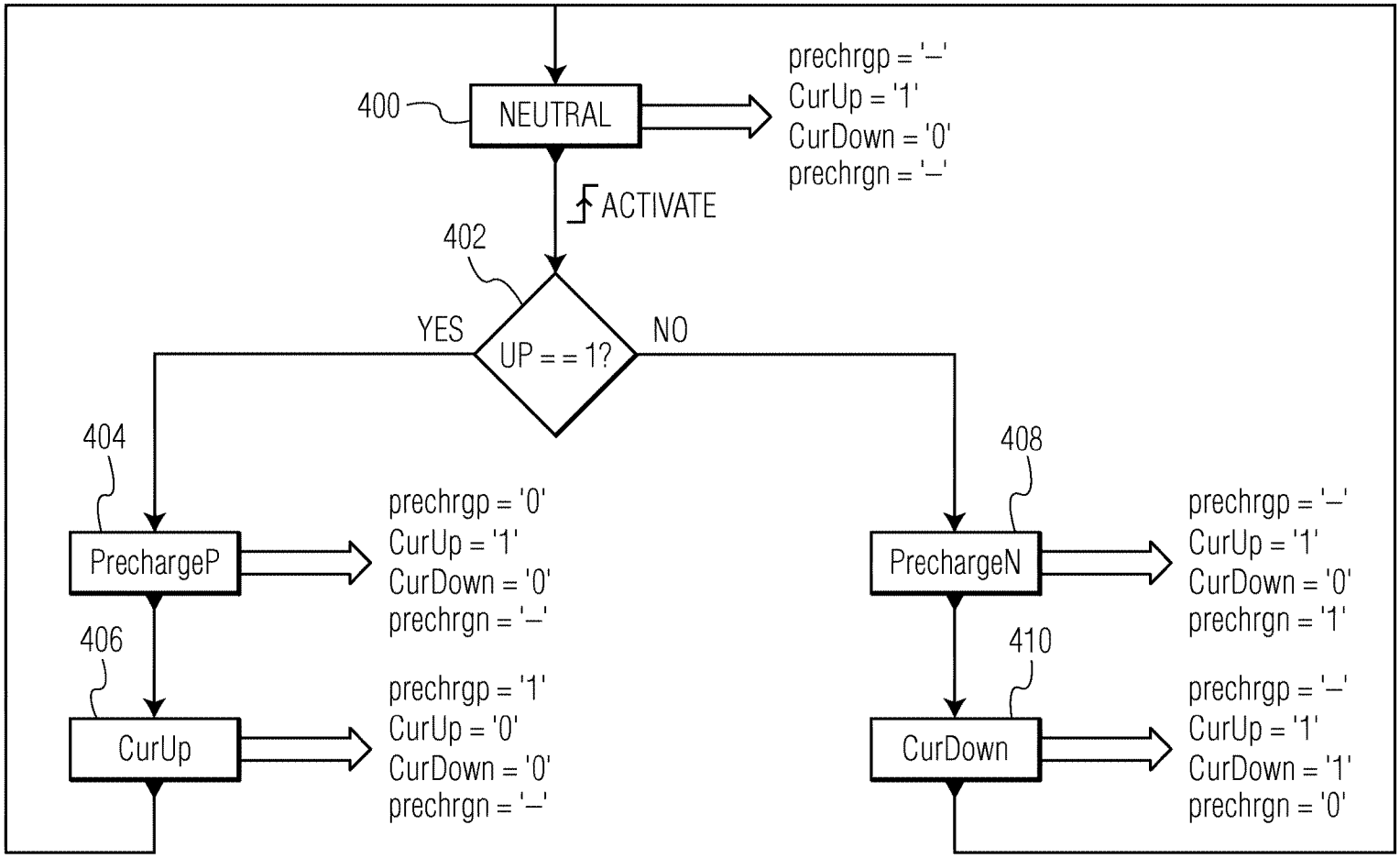
FIG. 4 is a flow chart that illustrates an exemplary operation of a digital controller depicted in FIG. 2.

FIG. 4 is a flow chart that illustrates an exemplary operation of the digital controller 202 depicted in FIG. 2. In the flow chart shown in FIG. 4, control signals, "prechrgp," and "CurUp," control the PMOS transistors, M1, M2, such that a value of '0' activates the PMOS transistors, M2, M3, while control signals "prechrgn," and "CurDown," control the NMOS switches, M4, M5, such that a value of '1' activates the NMOS transistors, M4, M5. In addition, a value of means that a signal has a value of either '1' or '0.' The digital controller begins operation at a neutral state in which the signal, "CurUp," is set to '1,' the signal, "CurDown," is set to '0,' and the control signals, "prechrgp," and "CurUp," are set to either '1' or '0,' at step 400. The digital controller determines the value of the signal, "up," at step 402. If the signal, "up," is at 1, the digital controller changes the state of the signal, "prechrgp," at a rising edge of the input signal, "activate," at step 404, and, subsequently, changes the state of the signal, "CurUp," at step 406. If the signal, "up," is at 0, the digital controller changes the state of the signal, "prechrgn," at a rising edge of the input signal, "activate," at step 408 and, subsequently, changes the state of the signal, "CurDown," at step 410. The digital controller goes back to the neutral state either after a predefined delay time or after a falling edge of the signal, "activate."

Figure 5:
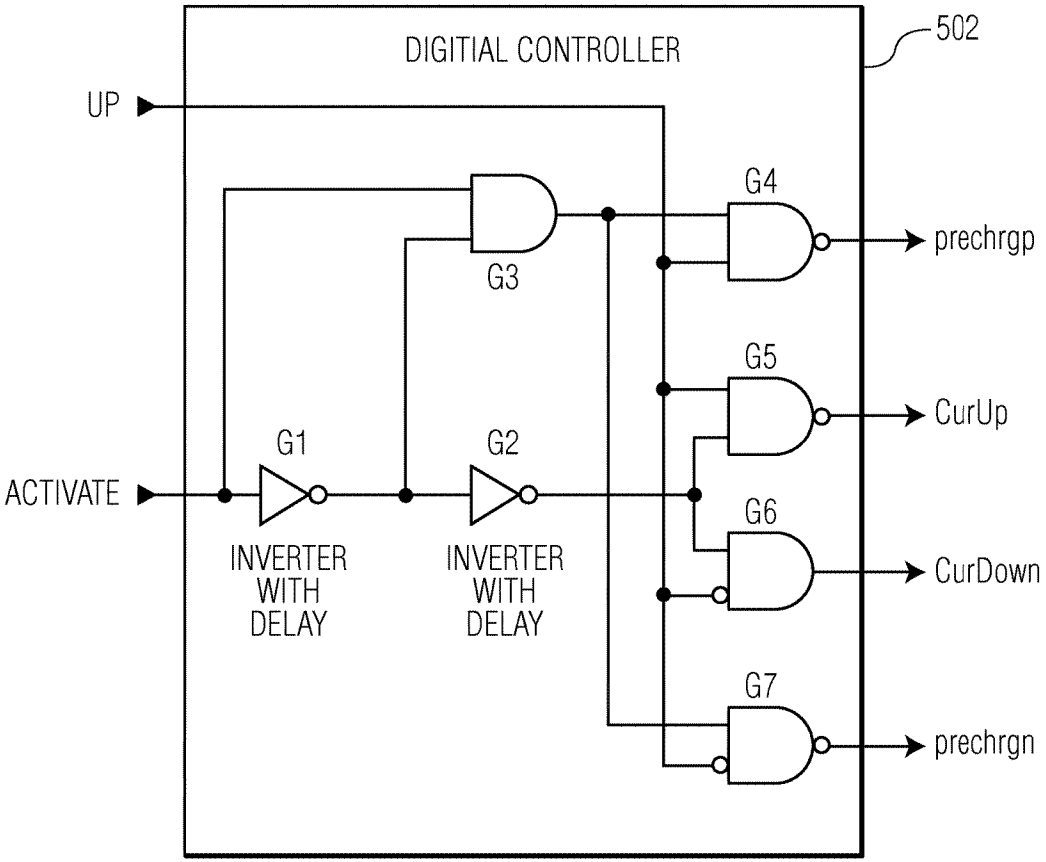
FIG. 5 depicts an embodiment of the digital controller depicted in FIG. 2 that is implemented by standard Boolean gates.

In some embodiments, the digital controller 202 depicted in FIG. 2 is implemented using one or more inverters and one or more plural-input single-output non-sequential logic devices. FIG. 5 depicts an embodiment of the digital controller depicted in FIG. 2 that is implemented by standard Boolean gates. In the embodiment depicted in FIG. 5, a digital controller 502 includes two inverters, "G1", "G2," with inverter delays, an AND gate, "G3," two NAND gates, "G4," "G5," and two AND gates (each with one inverting input and one non-inverting input), "G6," "G7." The digital controller depicted in FIG. 5 is one possible embodiment of the digital controller depicted in FIG. 2. However, the digital controller depicted in FIG. 2 is not limited to the embodiment shown in FIG. 5.

Figure 6:
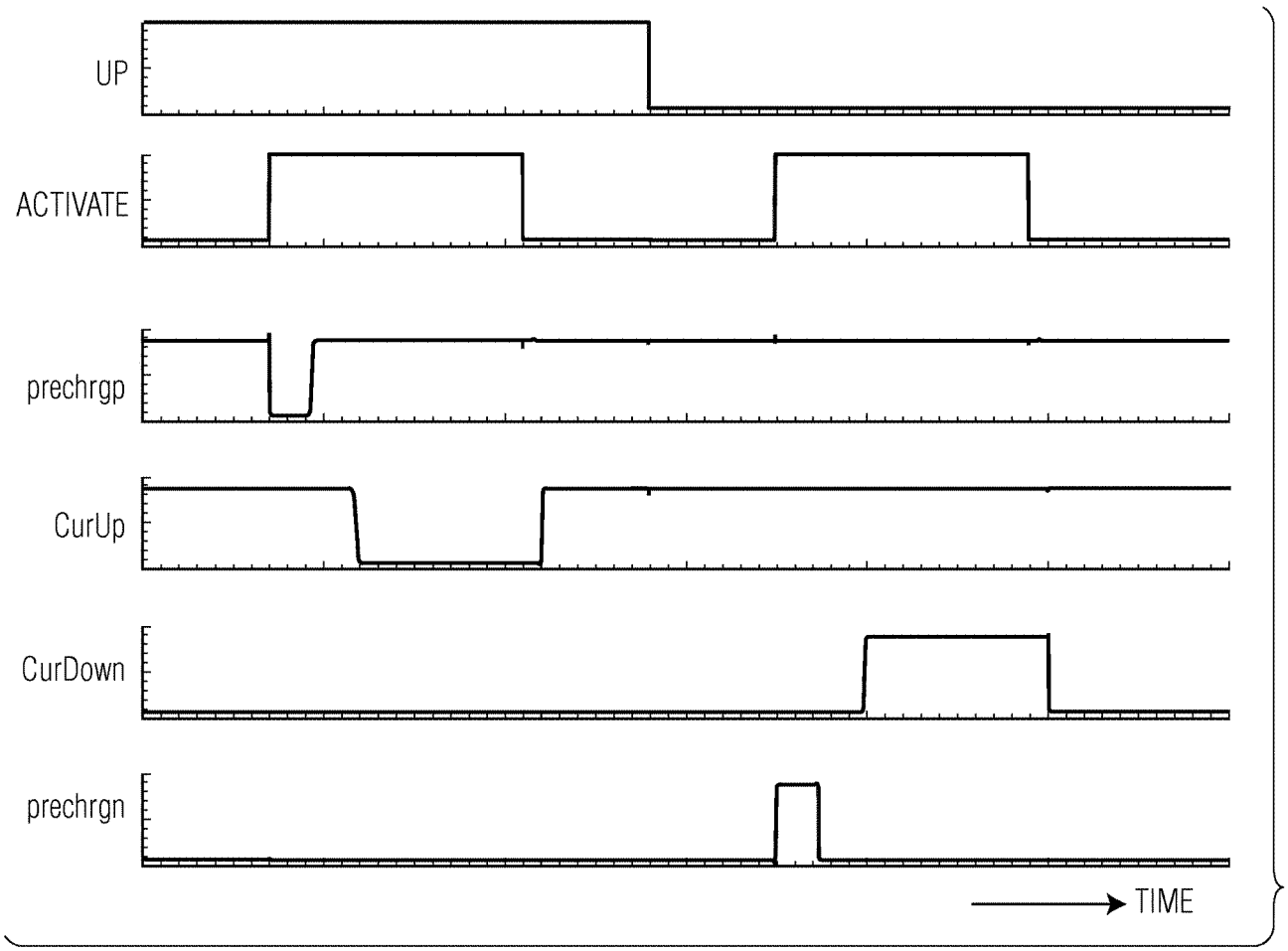
FIG. 6 shows some examples of input signals and output signals of the digital controller depicted in FIG. 5.

FIG. 6 shows some examples of input signals and output signals of the digital controller 502 depicted in FIG. 5. Specifically, FIG. 6 shows the input digital signals, "activate," "up," and the output signals, "prechrgp," "CurUp," "CurDown," "prechrgn," of the digital controller. The digital controller enters an active state after a rising edge of the digital activation signal, "activate," and sets the control signal, "prechrgp," to 0V. Subsequently, the digital controller sets the control signal, "CurUp," to 0V. The digital controller enters a neutral state after a falling edge of the digital activation signal, "activate," and re-enters the active state after another rising edge of the digital activation signal, "activate." Specifically, the digital controller sets the control signal, "prechrgn," to a positive voltage, and subsequently, sets the control signal, "CurDown," to a positive voltage.

Figure 7:
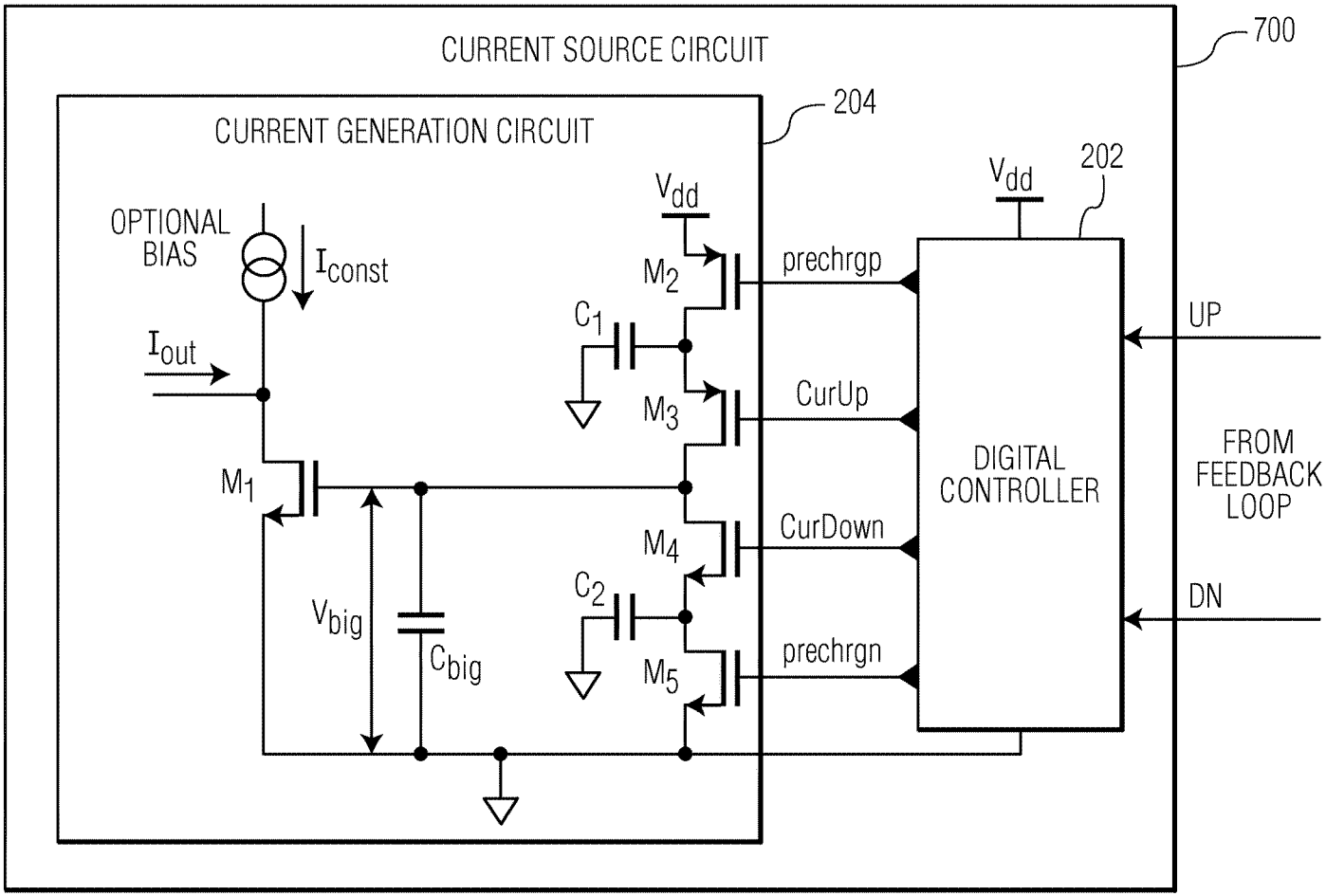
FIG. 7 depicts another embodiment of the power source circuit depicted in FIG. 1.

Although the current source circuit 200 is controlled by the signals, "up," "activate," in the embodiment depicted in FIG. 2, in other embodiments, other signals can be used to control the power source circuit 100. FIG. 7 depicts an embodiment of the power source circuit 100 depicted in FIG. 1 that is controlled by signals, "UP," and "DN." In the embodiment depicted in FIG. 7, a current source circuit 700 includes a digital controller 702 that is controlled by the signals, "UP," and "DN," and the current generation circuit 204. The electric charge on the capacitor, $C_{big}$, can be varied by the signals, "UP," and "DN." The transistors, M2, M3, M4, M5, either take away charge (the amount being proportional to the ratio of C2/Cbig) from the capacitor, $C_{big}$, or add charge (the amount being proportional to the ratio of C1/Cbig) to the capacitor, $C_{big}$, thereby changing the output current, "$I_{out}$."

In an example of the operation of the current source circuit 700, the digital controller 702 sets the control signal, "prechrgp," to 0 V in response to a surge in the signal, "DN," (i.e., when less output current is needed) thereby activating the transistor, M2, which charges the capacitor, C1, (which can be implicitly present as "parasitic" capacitance of transistors, M2 and M3, or as a separate device) to a positive voltage of Vdd. To transfer the electric charge on the capacitor, C1, to the capacitor, $C_{big}$, the signal, "prechrgp," returns to the neutral setting of Vdd by inactivating (i.e. turning off) the transistor, M2, after which transistor, M3, is activated (i.e. turned on) by setting the signal, "CurUp," equal to 0V. The charge across the capacitors, C1, and, $C_{big}$, then redistributes in a way that increases the voltage across the capacitor, $C_{big}$. The digital controller sets the control signal, "prechrgn," to a positive voltage of Vdd in response to a dip in the signal, "UP," (i.e., when more output current is needed) thereby activating (i.e. turning on) the transistor, M4, which discharges the voltage on the capacitor, $C_{big}$, to the capacitor, C2, (which can be implicitly present as "parasitic" capacitance of transistors, M4 and M5, or as a separate device).

The current source circuit 200 can be used to replace a digital-to-analog converter (DAC) in a DC offset cancellation circuit. For example, a DAC is typically inserted in an analog signal processing chain to counter the effect of DC offset in amplifier circuits that can cause distortion or even signal clipping. However, reaching the desired combination of accuracy and range of the DAC typically increases design complexity on the one hand and significantly increases silicon area on the other. In addition, the control algorithm of the DAC may require strict monotonicity of the DAC input-output relation. Typically, a thermometer coded DAC with accompanying binary-to-thermometer coder is employed to solve the monotonicity requirement by design, which again introduces design complexity. Compared with DACs that may can cause distortion or even signal clipping, the current source circuit 200 can be used in analog signal processing chains to cancel an unwanted DC element without these undesirable effects.

Figure 8:
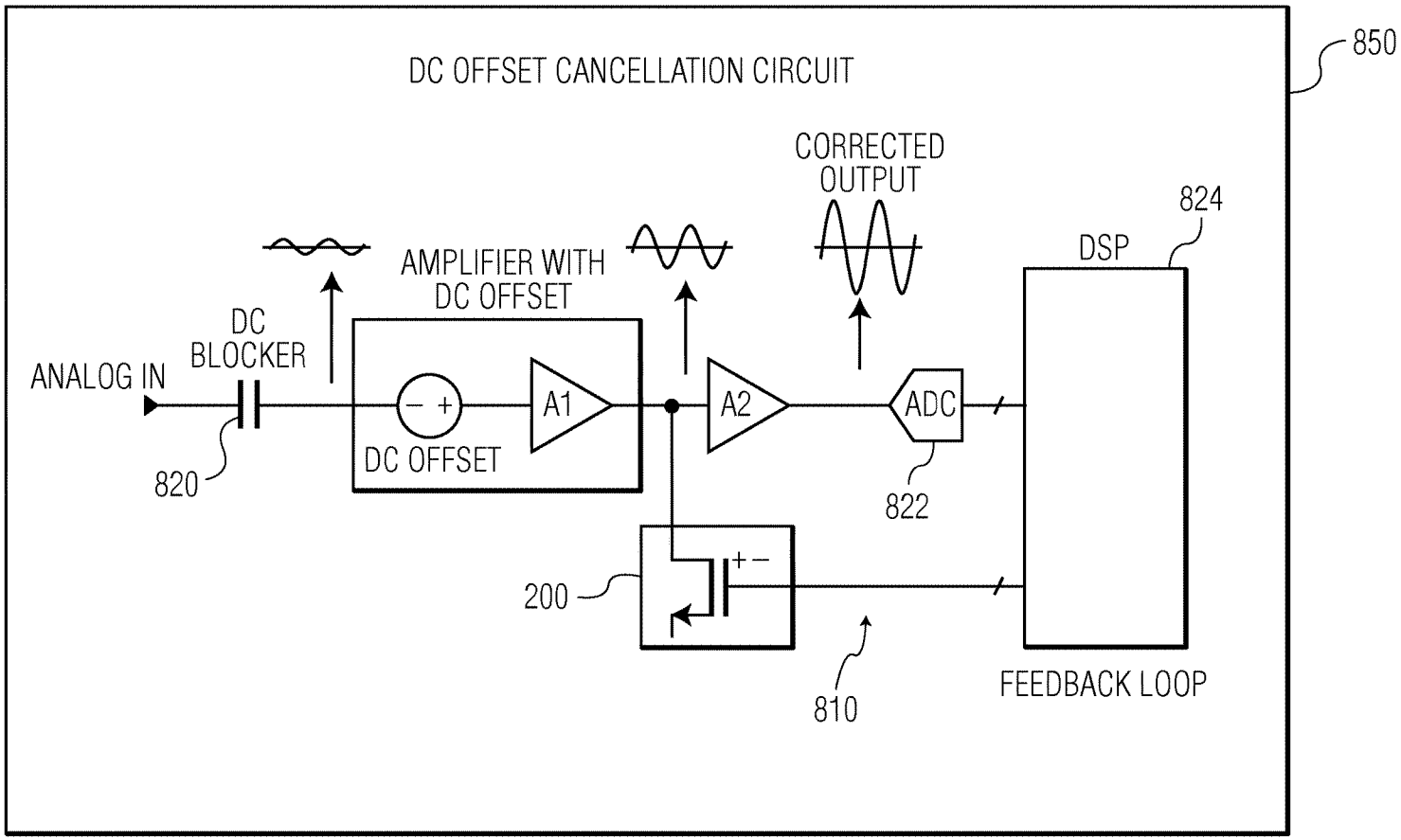
FIG. 8 depicts an embodiment of a DC offset cancellation circuit that includes the current source circuit depicted in FIG. 2.

FIG. 8 depicts an embodiment of a DC offset cancellation circuit 850 that includes the current source circuit 200 depicted in FIG. 2. The digitally controlled current source circuit can remove the DC offset in a DC feedback loop 810 of the DC offset cancellation circuit. Compared to a digital-to-analog converter (DAC), the current source circuit uses relative control inputs (e.g., up and down) rather than an absolute one as in a DAC. Consequently, the range of the DC offset cancellation circuit is decoupled from the accuracy (step size) of the DC offset cancellation circuit. In the embodiment depicted in FIG. 8, the DC offset cancellation circuit includes a DC blocker 820, an amplifier circuit, "A1," with DC offset, and the DC offset cancellation feedback loop 810, which includes an amplifier circuit, "A2," an analog-to-digital converter (ADC) 822, a digital signal processor (DSP) 824, and the current source circuit 200. In some embodiments, the DC offset cancellation circuit is used in a smartcard, such as a contactless smartcard.

Figure 9:
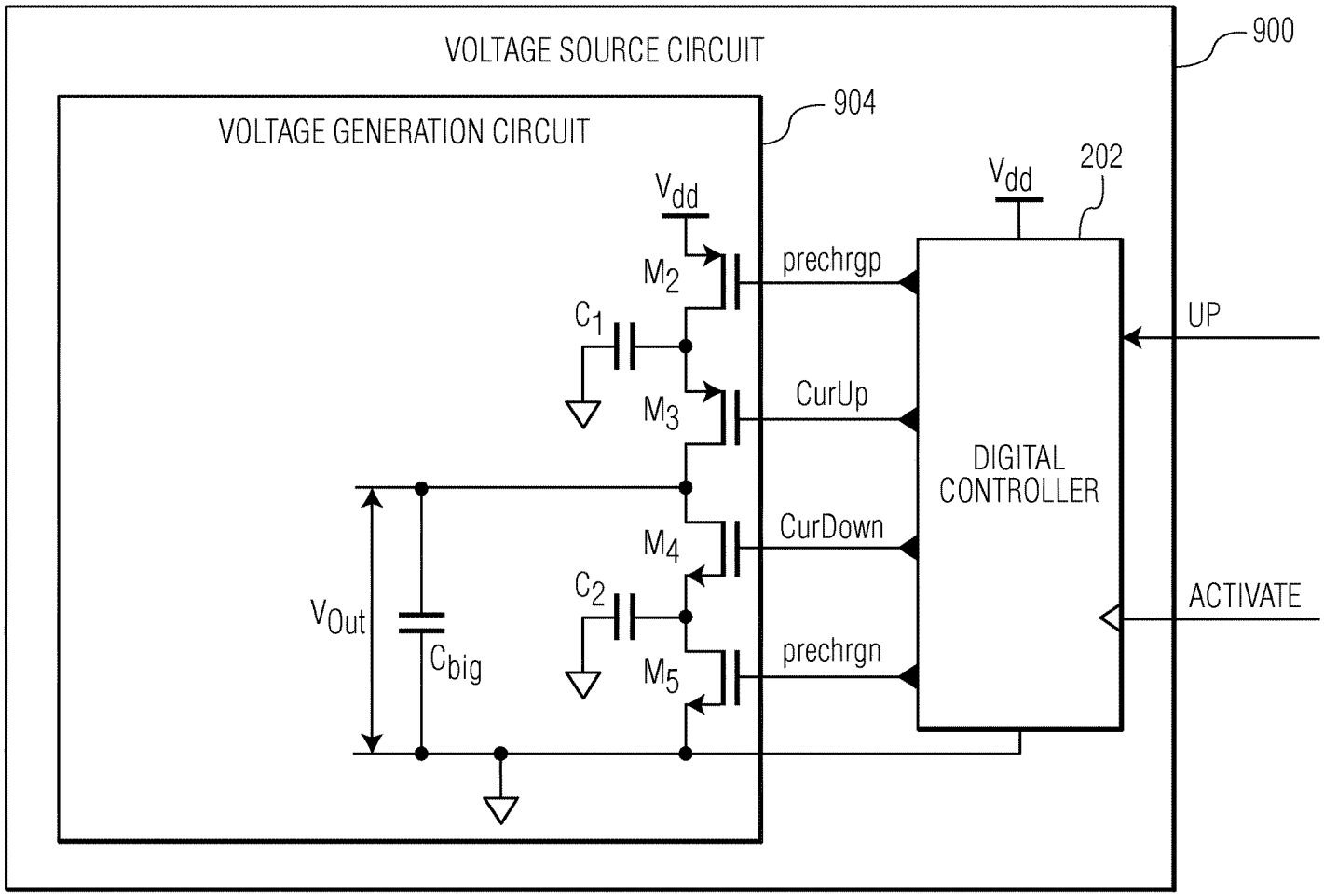
FIG. 9 depicts an embodiment of the power source circuit depicted in FIG. 1 that is used to generate an output voltage.

In some embodiments, the power source circuit 100 depicted in FIG. 1 is a voltage source circuit that is used to generate an output voltage. FIG. 9 depicts an embodiment of the power source circuit 100 depicted in FIG. 1 that is used to generate an output voltage, "$V_{out}$." In the embodiment depicted in FIG. 9, a voltage source circuit 900 includes a voltage generation circuit 904 and the digital controller 202. A difference between the voltage source circuit 900 and the current source circuit 200 is that the voltage source circuit 900 does not include the transistor, M1, which is used to generate the output current signal, "$I_{out}$," in the current source circuit 200 of FIG. 2. The voltage source circuit depicted in FIG. 9 is one possible embodiment of the power source circuit depicted in FIG. 1. However, the power source circuit depicted in FIG. 1 is not limited to the embodiment shown in FIG. 9.

Figure 10:
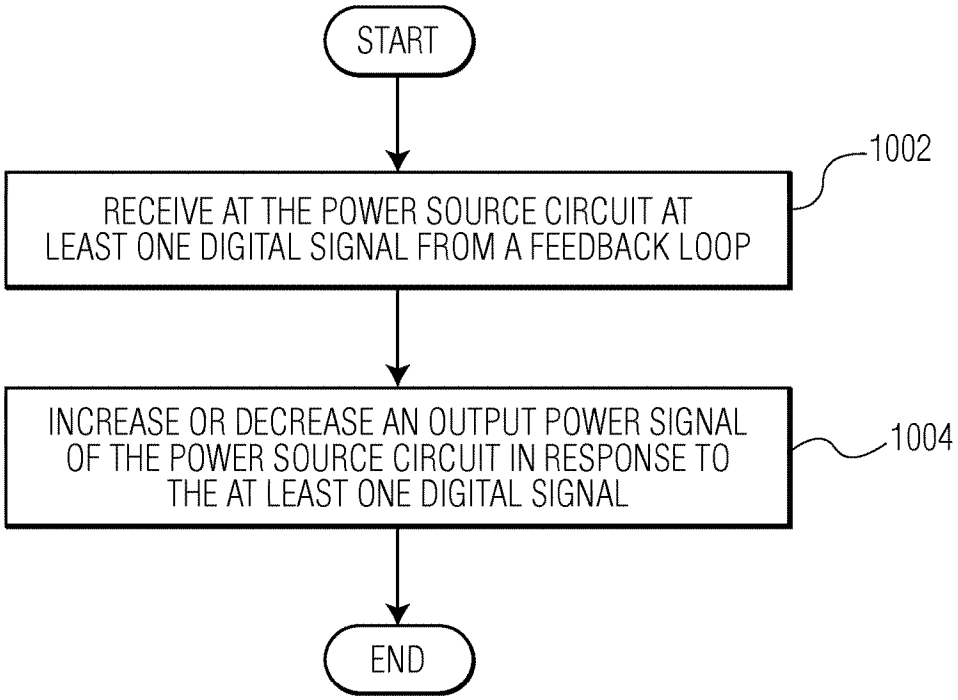
FIG. 10 is a process flow diagram of a method for operating a power source circuit in accordance with an embodiment of the invention.

FIG. 10 is a process flow diagram of a method for operating a power source circuit in accordance with an embodiment of the invention. The power source circuit may be similar to or the same as the power source circuit 100 depicted in FIG. 1, the current source circuit 200 depicted in FIG. 2, the current source circuit 700 depicted in FIG. 7, and/or the voltage source circuit 900 depicted in FIG. 9. At block 1002, at least one digital signal is received at the power source circuit from a feedback loop. At block 1004, output power signal of the power source circuit is increased or decreased an in response to the at least one digital signal.

The present disclosure extends to the following series of lettered causes: A current source circuit comprising a digital controller configured to receive a digital activation signal and a digital control signal from a feedback loop and a current generation circuit configured to increase or decrease an output current during a rising edge of the digital activation signal based on the Boolean value of the digital control signal, wherein the current generation circuit comprises a first type of switching devices, a second type of switching devices, and a capacitor connected to a node between the first type of switching devices and the second type of switching devices.

Although the operations of the method herein are shown and described in a particular order, the order of the operations of the method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

In addition, although specific embodiments of the invention that have been described or depicted include several components described or depicted herein, other embodiments of the invention may include fewer or more components to implement less or more features.

Furthermore, although specific embodiments of the invention have been described and depicted, the invention is not to be limited to the specific forms or arrangements of parts so described and depicted. The scope of the invention is to be defined by the claims appended hereto and their equivalents.

The invention claimed is:

1. A method for operating a power source circuit, the method comprising:

receiving at the power source circuit at least one digital signal from a feedback loop; and increasing or decreasing an output power signal of the power source circuit in response to the at least one digital signal, wherein the at least one digital signal comprises a digital activation signal and a digital control signal, wherein increasing or decreasing the output power signal of the power source circuit in response to the at least one digital signal comprises:

increasing or decreasing the output power signal during a rising edge of the digital activation signal based on the Boolean value of the digital control signal.

2. The method of claim 1, wherein increasing or decreasing the output power signal based on the Boolean value of the digital control signal during a rising edge of the digital activation signal comprises:

increasing the output power signal during the rising edge of the digital activation signal if the Boolean value of the digital control signal is 1; and decreasing the output power signal during a rising edge of the digital activation signal if the Boolean value of the digital control signal is 0.

3. The method of claim 1, wherein increasing or decreasing the output power signal of the power source circuit in response to the at least one digital signal comprises:

causing an increase or a decrease in a voltage of a capacitor connected to a node between a first type of switching devices and a second type of switching devices in response to the at least one digital signal.

4. The method of claim 3, wherein the first type of switching devices comprise a plurality of PMOS transistors, and wherein the second type of switching devices comprise a plurality of NMOS transistors.

5. The method of claim 3, wherein causing the increase or the decrease in the voltage of the capacitor comprises:

activating and subsequently deactivating a first switching device; and activating a second switching device, wherein the first and second switching devices are of the same type.

6. The method of claim 1, wherein the feedback loop is a direct current (DC) offset cancellation loop.

7. The method of claim 1, wherein the output power signal comprises an output current signal or an output voltage signal.

8. A power source circuit, the power source circuit comprising:

a digital controller configured to receive at least one digital signal from a feedback loop; and a power signal generation circuit configured to increase or decrease an output power signal in response to the at least one digital signal, wherein the at least one digital signal comprises a digital activation signal and a digital control signal, wherein the power signal generation circuit is further configured to:

increase or decrease the output power signal during a rising edge of the digital activation signal based on the Boolean value of the digital control signal.

9. The power source circuit of claim 8, wherein the power signal generation circuit is further configured to:

increase the output power signal during the rising edge of the digital activation signal if the Boolean value of the digital control signal is 1; and decrease the output power signal during a rising edge of the digital activation signal if the Boolean value of the digital control signal is 0.

10. The power source circuit of claim 8, wherein the power signal generation circuit comprises:

a first type of switching devices;

a second type of switching devices; and a capacitor connected to a node between the first type of switching devices and the second type of switching devices, wherein the digital controller is further configured to:

cause an increase or a decrease in a voltage of the capacitor in response to the at least one digital signal.

11. The power source circuit of claim 10, wherein the first type of switching devices comprise a plurality of PMOS transistors, and wherein the second type of switching devices comprise a plurality of NMOS transistors.

12. The power source circuit of claim 10, wherein the digital controller is further configured to:

activate and subsequently deactivate a first switching device of the power signal generation circuit; and activate a second switching device of the power signal generation circuit, wherein the first and second switching devices are of the same type.

13. A direct current (DC) offset cancellation circuit, the DC offset cancellation circuit comprising:

an amplifier; and the feedback loop of claim 8, wherein the feedback loop comprises:

the power source circuit of claim 8;

an analog-to-digital converter; and a digital signal processor.

14. A current source circuit, the current source circuit comprising:

a digital controller configured to receive a digital activation signal and a digital control signal from a feedback loop; and a current generation circuit configured to increase or decrease an output current during a rising edge of the digital activation signal based on the Boolean value of the digital control signal, wherein the current generation circuit comprises:

a first type of switching devices;

a second type of switching devices; and a capacitor connected to a node between the first type of switching devices and the second type of switching devices.

15. The current source circuit of claim 14, wherein the first type of switching devices comprise a first PMOS transistor and a second PMOS transistor that are connected in series, and wherein the second type of switching devices comprise a first NMOS transistor that is connected to the capacitor at a gate terminal and a source terminal of the first NMOS transistor and a second NMOS transistor and a third NMOS transistor that are connected in series.

16. The current source circuit of claim 15, wherein the digital controller is further configured to:

cause an increase or a decrease in a voltage of the capacitor in response to the digital activation signal and the digital control signal.

17. The current source circuit of claim 14, wherein the digital controller comprises:

a plurality of inverters; and a plurality of plural-input single-output non-sequential logic devices.

18. A direct current (DC) offset cancellation circuit, the DC offset cancellation circuit comprising:

an amplifier; and the feedback loop of claim 14, wherein the feedback loop comprises:

the current source circuit of claim 14;

an analog-to-digital converter; and a digital signal processor.

* * * * *